United States Patent [19]

Quantz

[11] Patent Number: 4,667,990

[45] Date of Patent: May 26, 1987

[54] ELECTRICALLY ACTUATED LOCK MECHANISM

[76] Inventor: Norman G. Quantz, 2584 Norway Lake Rd., Lapeer, Mich. 48446

[21] Appl. No.: 631,466

[22] Filed: Jul. 16, 1984

[51] Int. Cl.[4] ..... E05C 3/06

[52] U.S. Cl. ..... 292/201; 70/241; 292/216; 292/DIG. 43

[58] Field of Search ..... 292/201, 216, DIG. 43, 292/336.3; 70/241; 200/61.64, 61.67, 153 L

[56] References Cited

U.S. PATENT DOCUMENTS

| | | | |
|---|---|---|---|
| 2,636,949 | 4/1953 | Hunter | 200/153 L X |
| 2,768,252 | 10/1956 | Woods | 200/153 L X |
| 3,566,703 | 3/1971 | Van Noord | 292/201 X |
| 3,917,330 | 11/1975 | Quantz | 292/216 |
| 4,395,064 | 7/1983 | Bellot et al. | 292/201 |
| 4,468,941 | 9/1984 | Bascou | 292/201 X |
| 4,518,180 | 5/1985 | Kleefeldt et al. | 292/216 X |

FOREIGN PATENT DOCUMENTS

| | | | |
|---|---|---|---|
| 755206 | 8/1956 | United Kingdom | 200/153 L |

*Primary Examiner*—Kenneth J. Dorner
*Assistant Examiner*—Lloyd A. Gall
*Attorney, Agent, or Firm*—Remy J. VanOphem; James R. Ignatowski

[57] ABSTRACT

An electrically actuated rear deck lock mechanism which may be locked or unlocked in a conventional manner or by a remotely actuated solenoid located in the passenger compartment of the vehicle. The lock mechanism latches the deck lid by engaging a lock bar after closure of the deck lid and through the use of a cam entrapping the lock bar to move it to a locked position. Once in the locked position, the electrical locking mechanism is free of all mechanical forces applied to the latch member such that any forces experienced during normal operation of the vehicle are observed through the mechanical inner lock of the latch with the lock bar without undue effect on the electrical components of the latch. The lock mechanism can also be moved to a locking position without interfering with the electrical locking portion of the mechanism.

7 Claims, 12 Drawing Figures

ELECTRICALLY ACTUATED LOCK MECHANISM

BACKGROUND OF THE INVENTION

1. Field of the Invention

The invention is related to electrically actuated lock mechanisms and, in particular, to an electrically actuated lock mechanism for the rear deck lid of an automotive vehicle.

2. Description of the Prior Art

Lock mechanisms for the rear deck lid of automotive vehicles are well known in the art. In general, most of the rear deck lid locking mechanisms are purely mechanical and incorporate a latch member entrapping a mating member, such as a lock bar. The locking mechanism may be attached to the rear deck lid and the mating lock bar attached to a structural element of the vehicle below the lower extremity of the rear deck lid opening, or the locking mechanism may be attached to a structural member of the vehicle and the lock bar attached to the rear deck lid. Normally, the mechanical locking mechanisms are locked by slamming the rear deck lid closed causing the lock bar to engage the latch member displacing it to a locked position in which the lock bar is entrapped by the latch member. The latch member is mechanically released from its locked position by the rotary motion of a key actuated lock.

In recent years, rear deck lid lock mechanisms have been developed which permit the lock mechanism to be electrically unlatched from inside the vehicle's passenger compartment, as well as externally unlatched by means of the key lock. Typical electrically released rear deck lid lock mechanisms have been disclosed in Quantz, U.S. Pat. No. 3,917,330, and Allen, U.S. Pat. No. 3,504,511. Additionally, power locking mechanisms have been incorporated into the rear deck locking mechanism to displace the latch member to its locked position. Peters, in U.S. Pat. Nos. 3,580,623 and 3,596,484, discloses a hydraulic mechanism for displacing the latch member to the locked position when the rear deck lid is closed. Alternatively, Bellot, et al, U.S. Pat. No. 4,395,064, discloses a rear deck having an electric motor connected to a lock member and a latch member by a pair of lost motion links. De Claire, et al, U.S. Pat. No. 3,332,713, discloses an electrically driven latch closure having a motor driven rack engaging a toothed sector of the latch member to rotate the latch member between its open and latched position. Oishei, U.S. Pat. No. 3,113,447, and Lentz, et al, U.S. Pat. No. 3,016,968, disclose a pneumatically operated latch closure mechanism. Garvey, et al, U.S. Pat. No. 2,896,990, discloses a rear deck lid closure mechanism having an electrically driven jack screw for lowering the rear deck lid to its closed position after the latch mechanism has engaged the lock bar.

The invention is an improved rear deck lid mechanism which may be unlocked with a conventional key lock or by a solenoid remotely actuated from inside the vehicle's passenger compartment and may be latched by forceably slamming the rear deck lid to its closed position causing the latch member to move to its locked position or by lowering the deck lid with a force only sufficient for the lock bar to partially displace the latch member towards its locked position. The latch member thereafter will be electrically returned to its locked position.

SUMMARY OF THE INVENTION

The invention is an electrically actuated rear deck lid lock mechanism having a support frame, a lock member pivotally attached to the support frame having a first arm with a lock dog, and a latch member pivotally connected to the support frame displaceable between an open and locked position. The latch member has a dog catch which engages the lock dog to lock the latch member in the locked position. A catch slot receives a lock bar in its open position and entraps the lock bar in the locked position. Resilient means produce a first force which biases the latch member towards the open position and further produce a second force which biases the lock member to engage the lock dog with the dog catch for pivotally displacing the lock member against the force of the resilient means to thereby disengage the lock dog from the dog catch. The lock member further consists of a cam gear with a cam surface of a predetermined contour, an electric motor for rotating the cam gear, and at least one stud protruding from the cam gear which engages the latch member with the rotation of the cam gear to displace the latch member to its locked position. A cam actuated electrical switch is responsive to the displacement of the latch member from its open position towards its closed position for providing electrical power to the electrical motor and responsive to the contour of the cam surface for terminating the electrical power to the electric motor.

One object of the invention is to provide a lock mechanism which may be mechanically or electrically locked or unlocked. Another object of the invention is to provide a lock mechanism in which the electrical locking mechanism does not interfere with the mechanical locking of the lock mechanism. A further object of the invention is to provide a lock mechanism in which the electrical locking mechanism is free of all the mechanical forces applied to the latch member when the latch member is in its locked position. These and other objects of the invention will become more apparent from reading the specification in conjunction with the drawings.

DETAILED DESCRIPTION OF THE INVENTION

Figure 1:
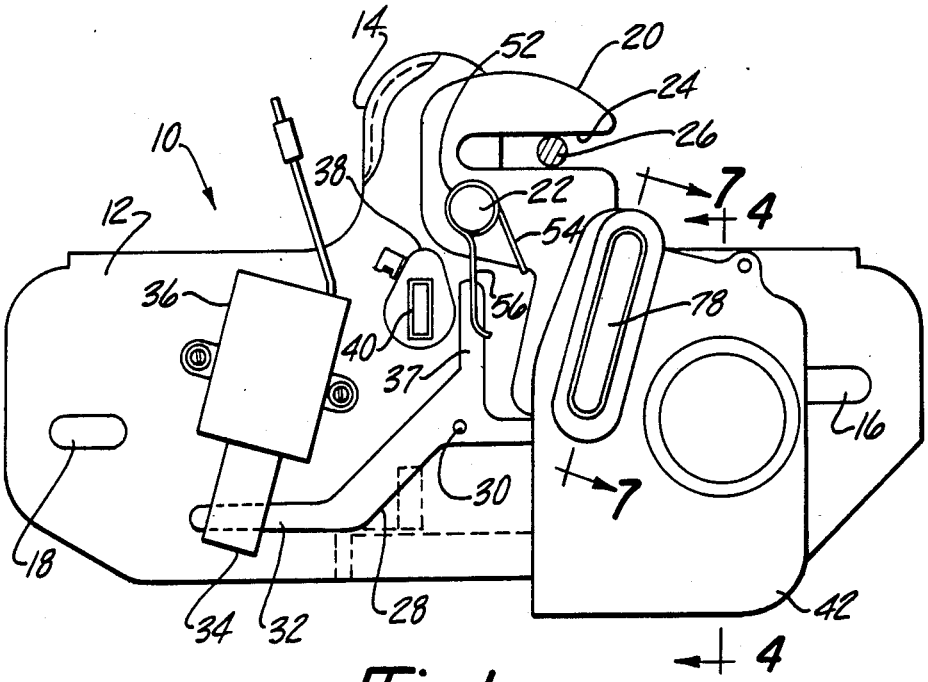
FIG. 1 is a plan view of the rear deck lid lock mechanism in the locked position.

The details of an electrically actuated rear deck lid lock mechanism 10 are shown in FIGS. 1 through 12. Referring first to FIG. 1, the deck lid lock mechanism 10 includes a support bracket 12 having an extension 14 protruding therefrom, and two mounting slots 16 and 18. As is known in the art, the deck lid lock mechanism may be attached to the vehicle's trunk lid or to a portion of the vehicle's frame just below the trunk lid opening depending upon the design of the vehicle.

A latch member 20, shown in the locked position, is pivotally connected to the bracket 12 by means of a first pivot pin 22. The latch member 20 has a laterally offset catch slot 24 which is located above the horizontal portion of the bracket 12 and captivates a lock bar 26 mounted on the rear deck lid when the latch member 20 is in the locked position, as shown, preventing the rear deck lid from being raised.

Figure 7:
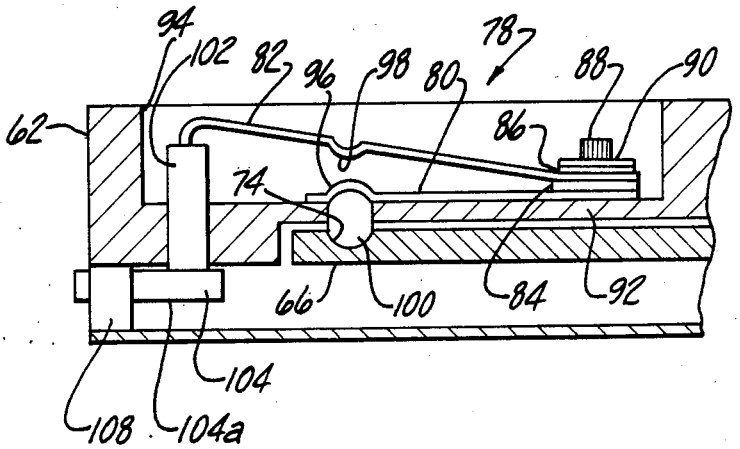
FIGS. 7, 9, 10 and 11 are partial cross-sectional views taken along line 7—7 of FIG. 1 of the electrical switch showing the position of its elements during various stages of its operational cycle.

A lock member 28 is pivotally connected to the bracket 12 by a second pivot pin 30 and locks the latch member 20 in the locked position as shall be explained with reference to FIG. 2. A leg 32 of the lock member 28 is captivated in an actuator arm 34 of a solenoid 36 attached to the support bracket 12. The solenoid 36 is connected to the vehicle's power supply through a switch (not shown) conveniently located in the vehicle's passenger compartment. A vertical arm 37 of the lock member 28 engages the surface of a cam 38 which is rotatably attached to the support bracket 12. The cam 38 has an elongated slot 40 for receiving the elongated extension bar of a manually key operated lock mechanism (not shown), such as is ordinarily provided on the vehicle for manually unlocking the trunk lid. An electrical lock mechanism 42, which has a cam actuated electrical switch mechanism 78, as shown in FIG. 7, automatically returns the latch member 20 to its locked position when the rear deck lid is lowered sufficiently to trip the latch member 20 as shall be explained hereinafter.

Figure 2:
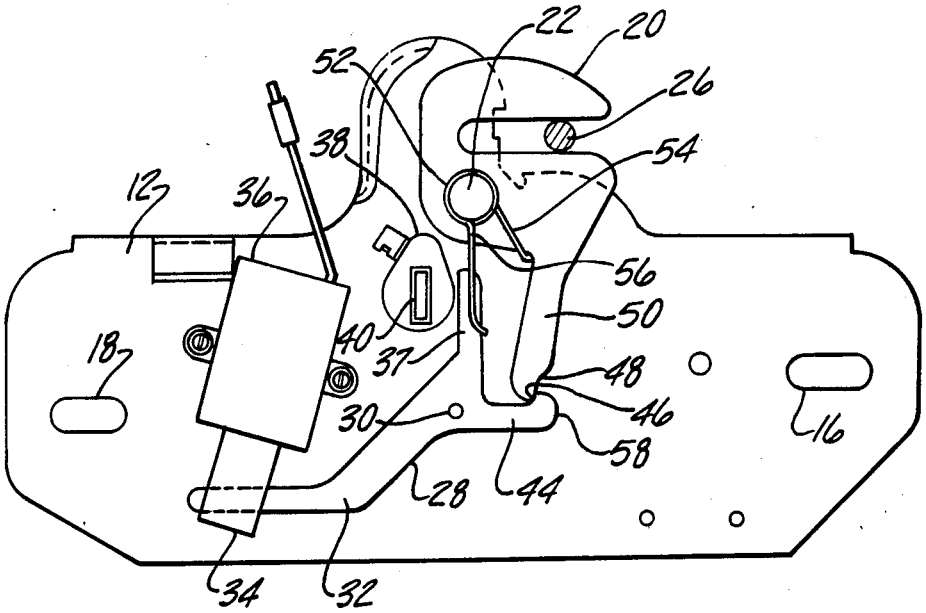
FIG. 2 is a plan view of the lock mechanism in the locked position with the electrical lock mechanism removed.
Figure 3:
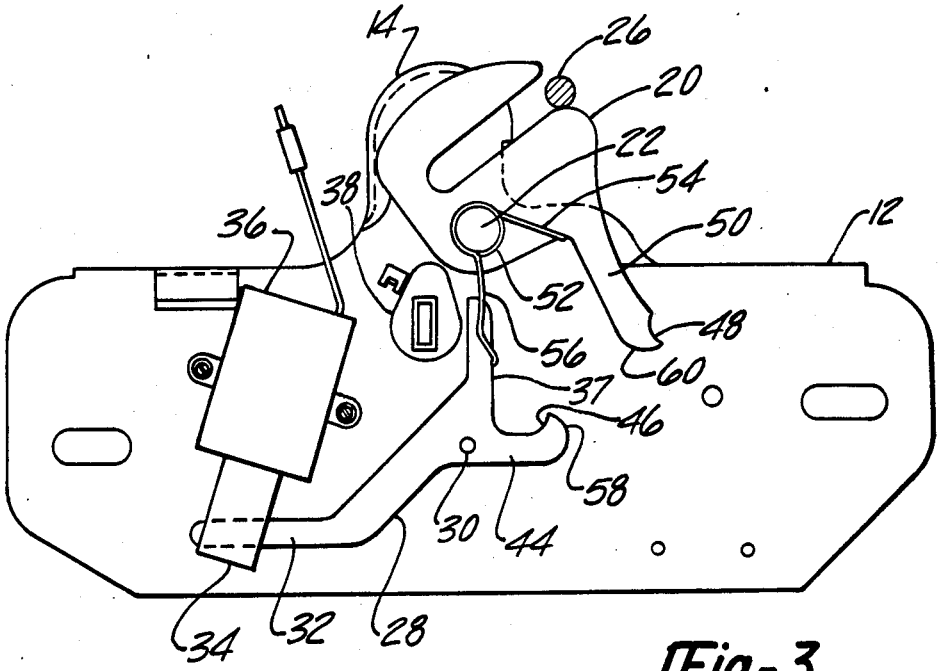
FIG. 3 is a plan view of the lock mechanism in the open position with the electrical lock mechanism removed.

Referring now to FIGS. 2 and 3, the electrical lock mechanism 42 is removed to show the details of the latch member 20 and the lock member 28. The lock member 28 has a second arm 44 extending generally normal to the vertical arm 37. At the end of the second arm 44 is a dog 46 which engages a dog catch 48 provided at the extremity of a lower extension 50 of the latch member 20. A coil spring 52, wound around the first pivot pin 22, has a first leg 54 which engages the latch member 20 below the first pivot pin 22 and produces a force which biases the latch member 20 to rotate in a counterclockwise direction about the first pivot pin 22. A second leg 56 of the coil spring 52 engages the vertical arm 37 of the lock member 28 producing a force biasing the vertical arm 37 of the lock member 28 into engagement with the cam 38 and the dog 46 into engagement with the dog catch 48 of the latch member 20.

Rotation of the cam 38 in a clockwise direction, as viewed in FIG. 2, by means of the manually key operated lock mechanism, or activating the solenoid 36 to retract the actuator arm 34, will rotate the lock member 28 in a clockwise direction disengaging the dog 46 from the dog catch 48 of the latch member 20. The coil spring 52, acting on the latch member 20, will cause the latch member to rotate in a counterclockwise direction to that of the position shown in FIG. 3. As shown in FIG. 3, the lock bar 26 engages the lower surface of the catch slot 24 at a point laterally offset from the first pivot pin 22 such that a force applied to the latch member 20 by the lock bar 26 will tend to rotate the latch member 20 towards the closed position.

Cooperation of an external curved surface 58, opposite the dog 46, and a curved surface 60, opposite the dog catch 48, will cause the lock member 28 to be displaced against the force of the coil spring 52 when a sufficient force is applied to the latch member 20 urging it towards its locked position. Once the dog catch 48 passes the dog 46, the force opposing the coil spring 52 returns the lock member 28 to its locked position with the vertical arm 37 engaging the surface of the cam 38 and the dog 46 engaging the dog catch 48 in order to lock the latch member 20 in its locked position.

Figure 4:
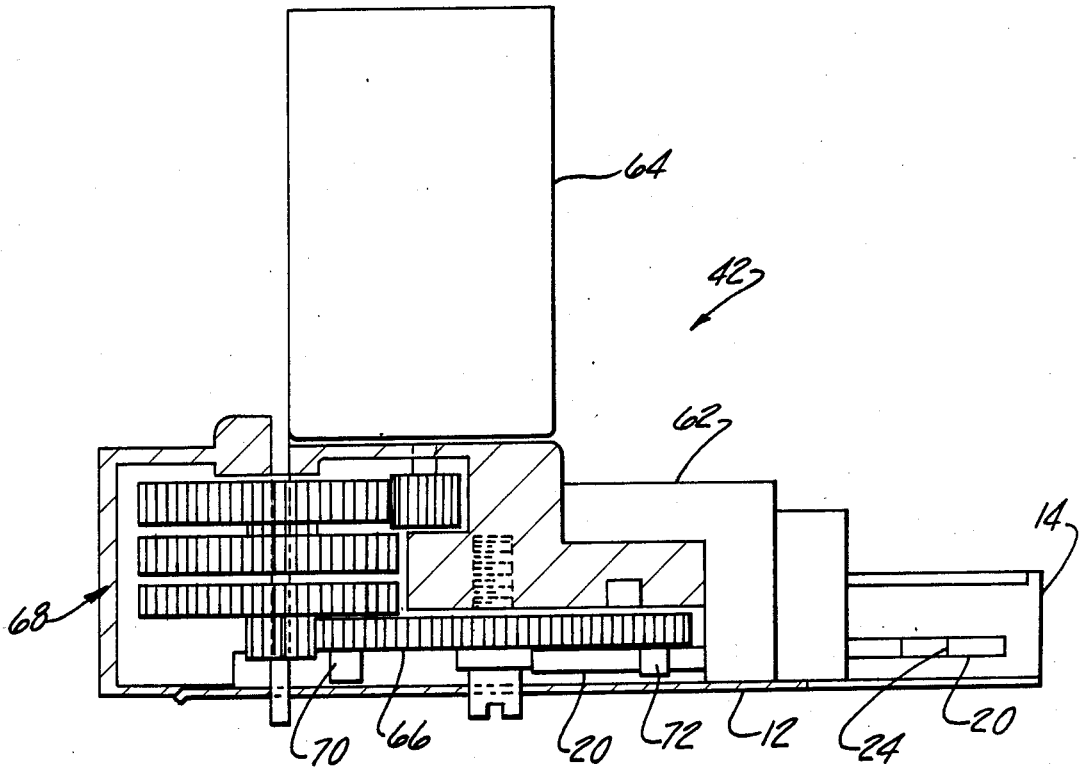
FIG. 4 is a partial cross-sectional view of the electrical locking mechanism taken along lines 4—4 of FIG. 1.

Referring to FIG. 4, the electrical lock mechanism includes a housing 62 attached to the support bracket 12 with a plurality of screws (not shown). Attached to the housing is a fractional horsepower electric motor 64 which drives a cam gear 66 through a series of speed reduction gears, collectively designated as gear train 68.

A pair of diametrically opposed studs 70 and 72, attached to the cam gear 66, protrude from the cam gear 66 and are operative upon rotation thereof to engage the edge of the latch member 20 and return the latch member 20 to its locked position. The two studs 70 and 72 are provided on the cam gear 66 so that the cam gear 66 only needs to rotate through one half of a revolution during each operating cycle. This reduces the time and electrical power required to complete each locking cycle.

Figure 5:
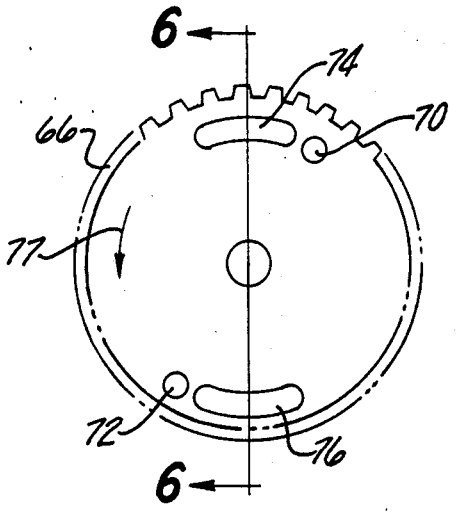
FIG. 5 is a front elevational view of the cam gear.
Figure 6:
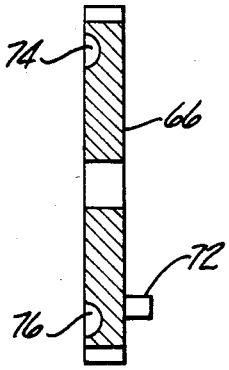
FIG. 6 is a cross-sectional partial view of the cam gear taken along lines 6—6 of FIG. 5.

As shown in FIG. 5, the cam gear 66 also has a pair of diametrically opposed arcuate cam grooves 74 and 76 formed in its upper surface immediately preceding each of the studs 70 and 72 in the control gear's direction of rotation, as shown by arrow 77 in FIG. 5. The arcuate cam grooves 74 and 76 cooperate with the cam actuated electrical switch mechanism 78 embodied in the housing 62 of the electrical lock mechanism 42 to lock and reset the switch mechanism.

Figure 9:
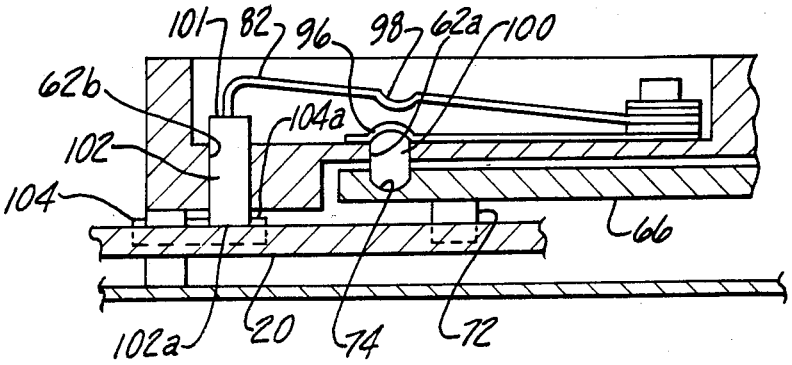
Figure 10:
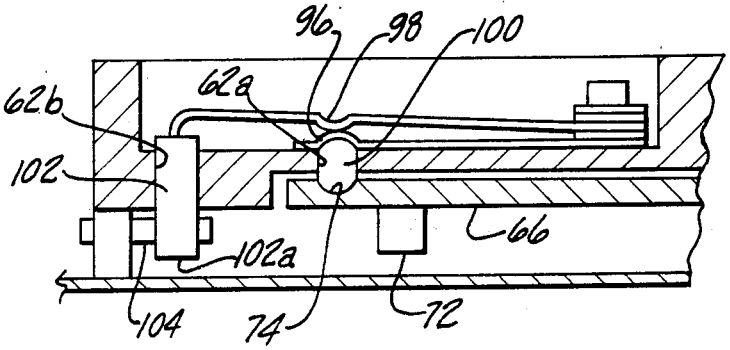
Figure 11:
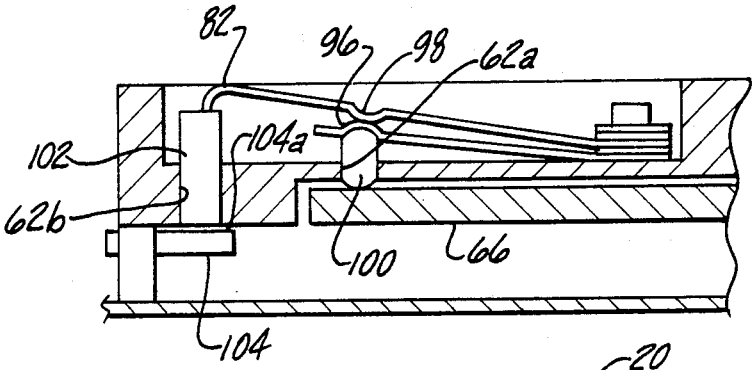

The details of the cam actuated electrical switch mechanism 78 are shown in FIG. 7. In FIG. 7, the cam actuated electrical switch mechanism 78 is shown in an open state, which occurs after the locking cycle is completed, and remains in this state until the rear deck lid is opened. FIGS. 9 through 11 show the state of the cam actuated electrical switch mechanism 78 during sequential stages of the locking cycle. Referring first to FIG. 7, the cam actuated electrical switch mechanism 78 includes a pair of spring contacts 80 and 82, separated at one end by an insulating washer 84. One of the spring contacts 80 and 82 is connected to the vehicle's source of electrical power, such as the vehicle's battery, and the other spring contact is connected to the electric motor 64. A collar 86 insulates a cap screw 88 and washer 90 from the spring contacts 80 and 82. The cap screw 88 and the washer 90 clamp the spring contacts 80 and 82 to a land 92 formed in the housing 62 at the bottom of an elongated cavity 94. Each of the spring contacts 80 and 82 is dimpled to form a pair of opposing electrical contacts 96 and 98, respectively. A cam follower 100 is provided in a first aperture **62*a* formed through the land 92 directly above the path of the opposed arcuate grooves 74 and 76. FIG. 7 shows the cam follower 100 in the arcuate groove 74 formed in the top surface of the cam gear 66. The spring contact 80 produces a force urging the cam follower 100 to engage the bottom of the arcuate cam groove 74 when the spring contact 80 is lying substantially parallel to the surface of the land 92**.

Figure 8:
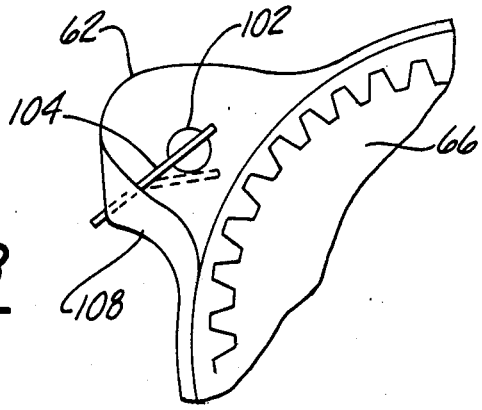
FIG. 8 is a partial view of the housing showing the details of the leaf spring relative to the post.

As shown in FIG. 9, a cylindrical post 102 is attached at one end 101 to the end of the spring contact 82, which is slidably received in a second aperture 62*b* in the land 92. In the open state of the cam actuated electrical switch mechanism 78, the cylindrical post 102 is held in a raised position by a leaf spring 104 engaging in its rest position the other end of the cylindrical post 102. The leaf spring 104 is held in position in the housing by pressing it through a slit formed through a leg 108 of the housing 62, as shown in FIGS. 7 and 8. FIG. 8 is view of a portion of the housing 62 directly below the cylindrical post 102. As shown, the leaf spring 104, in its rest position, lies directly beneath the cylindrical post 102 and is operatively displaced to the position shown in phantom by the latch member 20 when the latch member 20 is in its rest position, as shown in FIG. 3. With the leaf spring 104 displaced, as shown by the phantom line of FIG. 8, the cylindrical post 102 is urged by the spring contact 82 through the second aperture 62*b* in the land 92 to engage the top surface of the latch member 20 as shown in FIG. 9. In this position the lower surface 102*a* of the cylindrical post 102 is below the upper edge 104*a* of the leaf spring 104, thereby preventing the leaf spring 104 from returning to its rest position when the latch member 20 is subsequently withdrawn from this position by the closing of the rear deck lid. The electrical contacts 96 and 98 remain spatially separated when the bottom of the cylindrical post 102 is resting on the top surface of the latch member 20, as shown in FIG. 9.

When the rear deck lid is closed, the lock bar 26 engages the latch member 20 causing it to rotate in a clockwise direction about the first pivot pin 22, displacing the latch member 20 from below the cylindrical post 102. This permits the spring contact 82 to displace the cylindrical post 102 further down until the electrical contact 98 engages the electrical contact 96, as shown in FIG. 10. When the cylindrical post 102 is in its descended position, the latch member 20 is prevented from returning to its full open position, as shown in FIG. 3, resulting in the lock bar 26 being entrapped in the catch slot 24 even though the rear deck lid is not fully closed. The engagement of the electrical contacts 96 and 98 provides electrical power to the electric motor 64 which initiates the rotation of the cam gear 66. As the cam gear 66 rotates, the cam follower 100 initially rides in the bottom of one of the cam grooves 74 or 76. At the end of the cam groove 74 or 76 the cam follower 100 rises to the top surface of the cam gear 66, as shown in FIG. 11. The raising of the cam follower 100, out of the cam grooves 74 or 76, causes it to raise the spring contacts 80 and 82 upwardly, as shown. During the raising of the spring contacts 80 and 82, the electrical contacts 96 and 98 remain engaged with each other and continue to supply electrical power to the electric motor 64. The raising of the spring contacts 80 and 82 by the cam follower 100 riding on the top surface of the cam gear 66 lifts the cylindrical post 102 above the upper edge 104*a* of the leaf spring 104 permitting the leaf spring 104 to return to its rest position directly below the lower surface 102*a* of the cylindrical post 102. In this state of the cam actuated electrical switch mechanism 78, the electric motor will continue to rotate the cam gear 66 until the next cam groove is encountered. When the next cam groove is encountered, the cam follower 100 will descend into the next sequential cam groove and the cam actuated electrical switch mechanism 78 will return to its initial state, as shown in FIG. 7, terminating the supply of electrical power by the electric motor 64 and, thereby, terminating the rotation of the cam gear 66.

Figure 12:
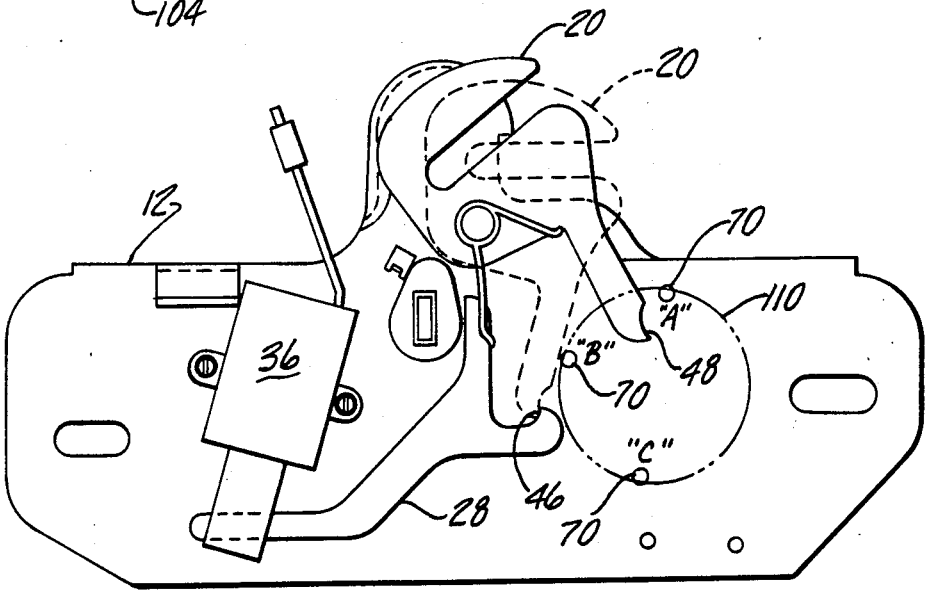
FIG. 12 is a plan view of the lock mechanism showing the path followed by the studs during the rotation of the cam gear.

As previously indicated, the two studs 70 and 72, protruding from the lower surface of the cam gear 66, engage the edge of the open latch member 20 and rotate the latch member in a clockwise direction to its locked position, entrapping the lock bar 26 in the catch slot 24. This is more clearly shown in FIG. 12 in which the circle designated 110 defines the external rotational path of the studs 70 and 72. In FIG. 12, position "A" designates the position of the stud 70 when the cam actuated electrical switch mechanism 78 is in its open position, as shown in FIG. 7. When the cam actuated electrical switch mechanism is closed, the stud 70 will rotate in a counterclockwise direction from position A and, after a predetermined rotation of the cam gear 66, will engage the edge of the latch member 20. Continued rotation of the cam gear 66 to position "B" will displace the latch member 20 towards its locked position a distance sufficient to cause the dog 46 of the lock member 28 to engage the dog catch 48 of the latch member 20, as shown in phantom, securing the latch member 20 in its locked position. After the latch member 20 is secured in its locked position, the cam gear 66 will continue to rotate disengaging the stud 70 from the latch member 20. The cam gear 66 will continue to rotate until the cam follower 100 of the cam actuated electrical switch mechanism 78 encounters the cam groove 76 associated with the diametrically opposed stud 72 where the electrical contacts 96 and 98 separate, as shown in FIG. 7. The separation of the electrical contacts 96 and 98 causes the motor to stop with the stud 70 at position "C", which is diametrically opposite to its starting position "A".

The operation of the rear deck lid lock mechanism is as follows:

When it is desired to open the rear deck lid, the operator may either activate the solenoid 36 from a remote location inside of the vehicle or may rotate the cam 38 by means of the manual key operated lock mechanism. Activating the solenoid 36 or rotating the cam 38 rotates the lock member 28 in a clockwise direction, as viewed in FIGS. 2 and 3, disengaging the dog 46 from the dog catch 48, allowing the coil spring 52 to rotate the latch member 20 to its open position. With the opening of the latch member 20, the lock bar 26 is displaced upwardly slightly raising the deck lid. The lock bar 26 is now clear of the catch slot 24, permitting the rear deck lid to be raised manually or under the influence of biasing means (not shown). If the rear deck lid is spring-loaded, it will automatically rise to its fully open position. The opening of the latch member 20 also displaces the vertical leaf spring 104 permitting the cylindrical post 102 to descend and engage the top surface of the latch member 20, setting the electrical locking mechanism for its closing cycle.

The rear deck lid may be closed by either of two methods. First, the deck lid may be closed in the conventional manner by applying a force sufficient for the lock bar 26 to rotate the latch member 20 to its locked position with the dog 46 engaging the dog catch 48. In the alternative, the deck lid may be locked only using a force sufficient to displace the latch member 20 away from under the cylindrical post 102 which causes the contacts 96 and 98 of the cam actuated electrical switch mechanism 78 to close and energize the electric motor 64. The electric motor will then drive the cam gear 66 and the stud 70 or 72 will displace the latch member 20 to its locked position as previously described, locking the deck lid in its closed position.

One advantage of the rear deck lid lock mechanism is that the locking of the rear deck lid in its closed position is assured, independent of the closing force. Another advantage of the rear deck lid lock mechanism is that the deck lid does not have to be slammed down to set the latch member in its locked position. Still another advantage of the rear deck lid lock mechanism is that the deck lid may be locked mechanically or electrically. A further advantage is that once the latch member is in the locked position, the electrical locking mechanism is disengaged from the latch member and all subsequent forces applied to the deck lid are sustained by the mechanical elements of the lock and not by any of the components in the electrical locking mechanism.

It is intended that the invention not be limited to the specific embodiment illustrated in the drawings and discussed in the detailed description above. It is recognized that a person skilled in the art will be able to conceive different structural arrangements for performing the equivalent functions without departing from the spirit of the invention as described above and set forth in the appended claims.

What is claimed is as follows:

1. A locking mechanism for entrapping a lock bar comprising:

a support frame;

a lock member pivotally attached to said support frame, said lock member having a first arm with a lock dog;

a latch member pivotally attached to said support frame and pivotally displaceable between an open and a locked position, said latch member having a dog catch at one end engaging said lock dog to lock said latch member in said locked position and a catch slot at the other end receiving said lock bar in said open position and entrapping said lock bar in said locked position, said latch member further having a planar top surface;

resilient means for producing a first force biasing said latch member to said open position and a second force biasing said lock member to engage said lock dog with said dog catch;

means for pivotally displacing said lock member against said second force to disengage said lock dog from said dog catch;

a housing attached to said support frame;

a cam gear comprising a cam surface having a predetermined contour, said cam gear being rotatably disposed in said housing;

an electric motor for unidirectionally rotating said cam gear;

at least one stud protruding from said cam gear, said at least one stud engaging said latch member intermediate said one end and said other end as said cam gear rotates to displace said latch member to its locked position; and a cam actuated switch responsive to the displacement of said latch member from its open position towards its closed position by the engagement of said lock bar with said latch member for providing electrical power to said electric motor and responsive to the contour of said cam surface for terminating said electrical power to said electric motor after said at least one stud has displaced said latch member to its locked position.

2. The locking mechanism of claim 1 wherein said cam actuated switch comprises:

a first contact spring having a fixed end attached to said housing and a free end;

a cam follower disposed between said free end of said first contact spring and said cam surface;

a second contact spring disposed above said first contact spring, said second contact spring having a fixed end, attached to said housing and electrically insulated from said first contact spring, and a free end;

a post attached to said free end of said second contact spring slidably disposed through an aperture in said housing above the location of said latch member in its open position; and a leaf spring attached to said housing comprising a rest position engaging the end of said post opposite said second contact spring when said second contact spring is resiliently displaced a predetermined distance in a direction away from said latch member, said leaf spring resiliently displaced from its rest position by said latch member in its open position a distance sufficient to allow said second contact spring to displace said post to engage said top surface of said latch member and inhibit the return of said leaf spring to its rest position.

3. The locking mechanism of claim 2 wherein said cam surface is an arcuate cam groove provided in said cam surface of said cam gear and extending a predetermined circumferential distance relative to said at least one stud; and wherein said first contact spring is resiliently displaced away from an initial position by said cam follower rising out of said groove of said cam gear and said first contact spring resiliently returns to said initial position when said cam follower descends into said cam groove, said first contact spring providing a resilient force urging said cam follower to follow said predetermined contour defined by said cam groove in said cam gear.

4. The locking mechanism of claim 3 wherein said at least one stud further comprises another stud diametrically opposed said at least one stud on said surface of said cam gear and wherein said cam gear comprises two diametrically opposite cam grooves.

5. The locking mechanism of claim 1 wherein said means for pivotally displacing said lock member comprises a cam rotatably attached to said support frame and engaging said lock member, said cam operative to displace said lock member to disengage said lock dog from said dog catch in response to being rotated by a key operated lock.

6. The locking mechanism of claim 1 wherein said means for pivotally displacing said lock member comprises a solenoid engaging said lock member and operative to pivotally displace said lock member to disengage said lock dog from said dog catch in response to being energized from a remote location.

7. The locking mechanism of claim 6 wherein said means for pivotally displacing said lock member further comprises a cam rotatably attached to said support frame and engaging said lock member, said cam operative to pivotally displace said lock member to disengage said lock dog from said dog catch in response to being rotated by a key operated lock.

* * * * *

UNITED STATES PATENT AND TRADEMARK OFFICE

CERTIFICATE OF CORRECTION

PATENT NO. : 4,667,990

DATED : May 26, 1987

INVENTOR(S) : Norman G. Quantz

It is certified that error appears in the above-identified patent and that said Letters Patent is hereby corrected as shown below:

Column 1, line 58, after "lid" insert ---- lock ----.

Column 2, line 28, after "the" delete "electrical" second occurence and insert ---- electric ----.

Signed and Sealed this

Sixth Day of October, 1987

*Attest:*

DONALD J. QUIGG

*Attesting Officer*

*Commissioner of Patents and Trademarks*